US006533037B2

(12) United States Patent
Eslinger et al.

(10) Patent No.: US 6,533,037 B2
(45) Date of Patent: Mar. 18, 2003

(54) FLOW-OPERATED VALVE

(75) Inventors: David M. Eslinger, Broken Arrow, OK (US); Howard L. McGill, Lufkin, TX (US); James M. Costley, Freeport, TX (US); Randolph J. Sheffield, Missouri City, TX (US); Warren M. Zemlak, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/725,779

(22) Filed: Nov. 29, 2000

(65) Prior Publication Data

US 2002/0062963 A1 May 30, 2002

(51) Int. Cl.[7] ..... E21B 34/10; E21B 43/26

(52) U.S. Cl. ..... 166/319; 166/308; 166/332.1; 166/177.5

(58) Field of Search ..... 166/308, 319, 166/381, 320, 332.1, 177.5, 118, 129, 183

(56) References Cited

U.S. PATENT DOCUMENTS 3,361,204 A * 1/1968 Howard et al. ..... 166/186
3,430,701 A * 3/1969 Canada ..... 166/156
4,815,538 A * 3/1989 Burroughs ..... 166/186
5,291,947 A * 3/1994 Stracke ..... 166/187
5,295,393 A * 3/1994 Thiercelin ..... 166/271
5,361,836 A * 11/1994 Sorem et al. ..... 166/187
5,456,322 A * 10/1995 Tucker et al. ..... 166/386
6,206,133 B1 * 3/2001 Paulsson ..... 166/206

OTHER PUBLICATIONS

Petro–Tech Tools, Inc. Technical Manual (1999).
Baker Oil Tools Packer Systems Catalog (1996).
Schlumberger Workover and Remedial Tools 2000–2001 Catalog (2000).

* cited by examiner

*Primary Examiner*—David Bagnell
*Assistant Examiner*—Jennifer R Dougherty
(74) *Attorney, Agent, or Firm*—Wayne I. Kanak; Brigitte L. Jeffery; John J. Ryberg

(57) ABSTRACT

A tool string, such as one used for performing fracturing operations or other types of operations, includes a valve, a valve operator, and a sealing assembly that in one arrangement includes packers to define a sealed zone. The tool string is carried on a tubing, through which fluid flow may be pumped to the sealed zone. The valve operator is actuated in response to fluid flow above a predetermined flow rate. When the flow rate at greater than the predetermined flow rate does not exist, the valve operator remains in a first position that corresponds to the valve being open. However, in response to a fluid flow rate at greater than the predetermined flow rate, the valve operator is actuated to a second position to close the valve.

26 Claims, 3 Drawing Sheets

FLOW-OPERATED VALVE

TECHNICAL FIELD

The invention relates to valves for use in wellbores.

BACKGROUND

After a wellbore is drilled, various completion operations are performed to enable production of well fluids. Examples of such completion operations include the installation of casing, production tubing, and various packers to define zones in the wellbore. Also, a perforating string is lowered into the wellbore and fired to create perforations in the surrounding casing and to extend perforations into the surrounding formation.

To further enhance the productivity of a formation, fracturing may be performed. Typically, fracturing fluid is pumped into the wellbore to fracture the formation so that fluid flow conductivity in the formation is improved to provide enhanced fluid flow into the wellbore.

A typical fracturing string includes an assembly carried by coiled tubing, with the assembly including a straddle packer tool having sealing elements to define a sealed interval into which fracturing fluids can be pumped for communication with the surrounding formation. The fracturing fluid is pumped down the coiled tubing and through one or more ports in the straddle packer tool into the sealed interval.

After the fracturing operation has been completed, clean-up of the wellbore and coiled tubing is performed by pumping fluids down an annulus region between the coiled tubing and casing. The annulus fluids push debris (including fracturing proppants) and slurry present in the interval adjacent the fractured formation and in the coiled tubing back out to the well surface. This clean-up operation is time consuming and is expensive in terms of labor and the time that a wellbore remains inoperational. By not having to dispose of slurry, returns to surface are avoided along with their complicated handling issues. More importantly, when pumping down the annulus between coiled tubing and the wellbore, the zones above the treatment zone can be damaged by this clean-out operation. Further, under-pressured zones above the straddled zone can absorb large quantities of fluids. Such losses may require large volumes of additional fluid to be kept at surface for the sole purpose of clean-up.

An improved method and apparatus is thus needed for performing clean-up after a fracturing operation.

SUMMARY

In general, in accordance with an embodiment, a tool for use in a wellbore comprises a flow conduit through which fluid flow can occur and a valve assembly adapted to be actuated between an open and closed position in response to fluid flow at greater than a predetermined rate.

Other features and embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible. For example, although reference is made to a fracturing string in the described embodiments, other types of tools may be employed in further embodiments.

As used here, the terms "up" and "down"; "upward" and downward"; "upstream" and "downstream"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
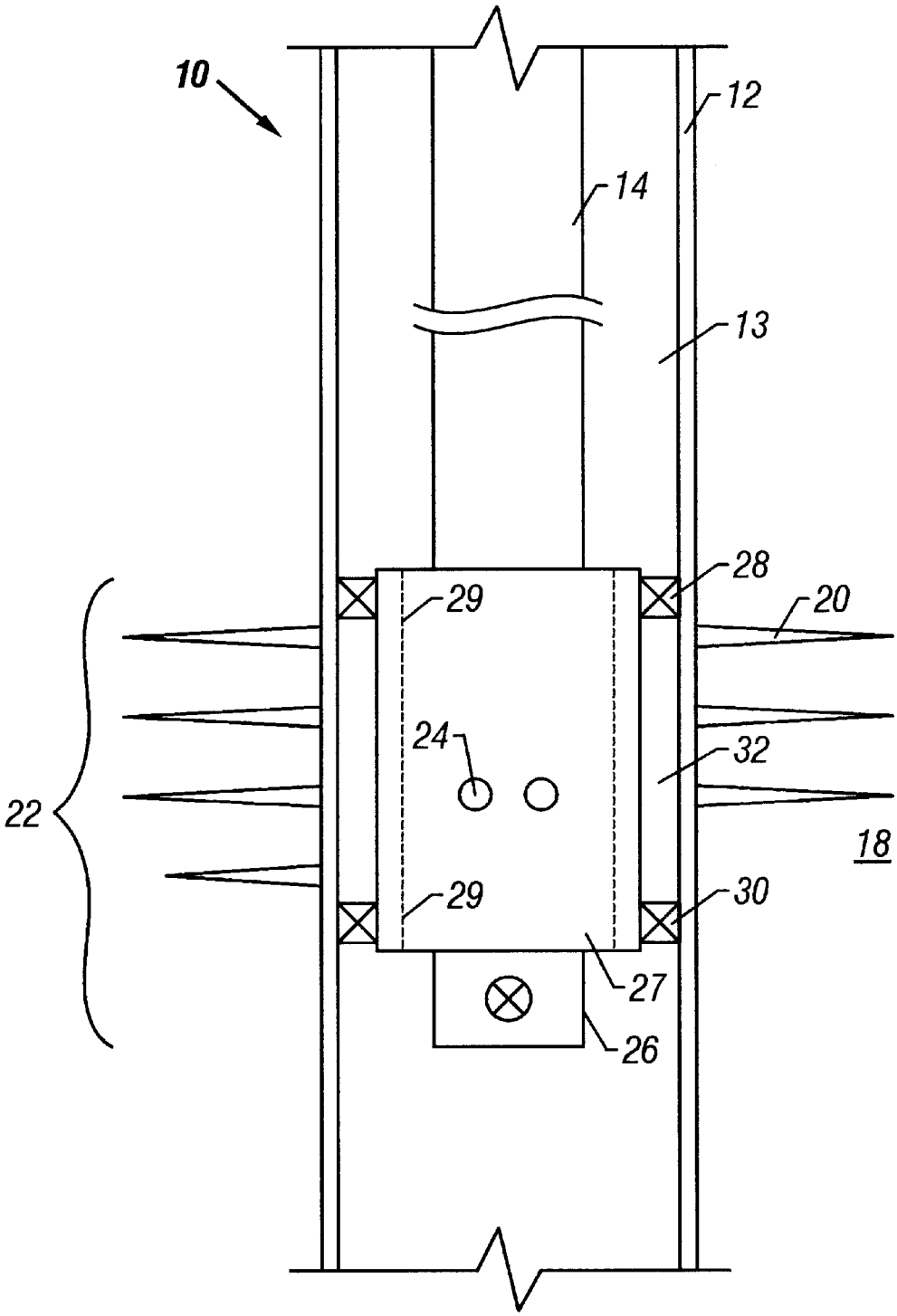
FIG. 1 illustrates an example embodiment of a fracturing string.

Referring to FIG. 1, a tool string in accordance with an embodiment is positioned in a wellbore 10. The wellbore 10 is lined with casing 12 and extends through a formation 18 that has been perforated to form perforations 20. To perform a fracturing operation, a straddle packer tool 22 carried on a tubing 14 (e.g., a continuous tubing such as coiled tubing or a jointed tubing such as drill pipe) is run into the wellbore 10 to a depth adjacent the perforated formation 18. The straddle packer tool 22 includes upper and lower sealing elements (e.g., packers) 28 and 30. When set, the sealing elements 28 and 30 define a sealed annulus zone 32 outside the housing of the straddle packer tool 22. The sealing elements 28 and 30 are carried on a ported sub 27 that has one or more ports 24 to enable communication of fracturing fluids pumped down the coiled tubing 14 to the annulus region 32.

In accordance with some embodiments of the invention, a dump valve 26 is connected below the ported sub 27. During a fracturing operation, the dump valve 26 is in the closed position so that fluids that are pumped down the coiled tubing 14 flow out through the one or more ports 24 of the ported sub 27 to the annulus region 32 and into the surrounding formation 18. After the fracturing operation has been completed, the dump valve 26 is opened to dump slurry and debris in the annulus region 32 and in the coiled tubing 14 to a region of the wellbore 10 below the tool string. By using the dump valve 26, pumping relatively large quantities of fluid down the annulus 13 between the coiled tubing 14 and the casing 12 to perform clean-up can be avoided. The relatively quick dumping mechanism provides for quicker operation of clean-up operations, resulting in reduced costs and improved operational productivity of the wellbore.

Furthermore, in accordance with some embodiments, the dump valve 26 is associated with a valve operator that is controlled by fluid flow in the coiled tubing 14 and the packer tool 22. When fracturing fluid flow is occurring, the dump valve 26 remains in the closed position to prevent communication of fracturing fluid into the wellbore 10. However, before fracturing fluid flow begins (such as during run-in) and after fracturing operation has completed and the fracturing fluid flow has stopped, the dump valve 26 is opened.

By employing a valve operator that is controlled by fluid flow rather than mechanical manipulation from the well surface, a more convenient valve operation mechanism is provided. A further advantage is that valve operation is effectively automated in the sense that the dump valve is automatically closed once a fluid flow of greater than a predetermined rate is pumped and open otherwise.

Figure 2A:
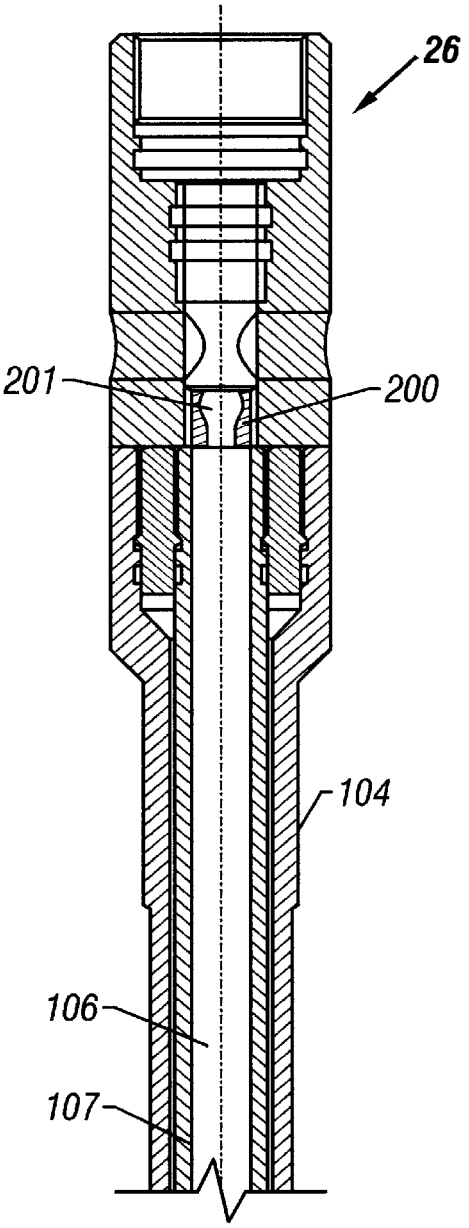
FIGS. 2A–2C are a vertical cross-sectional view of a valve in accordance with an embodiment used with the fracturing string of FIG. 1.
Figure 2B:
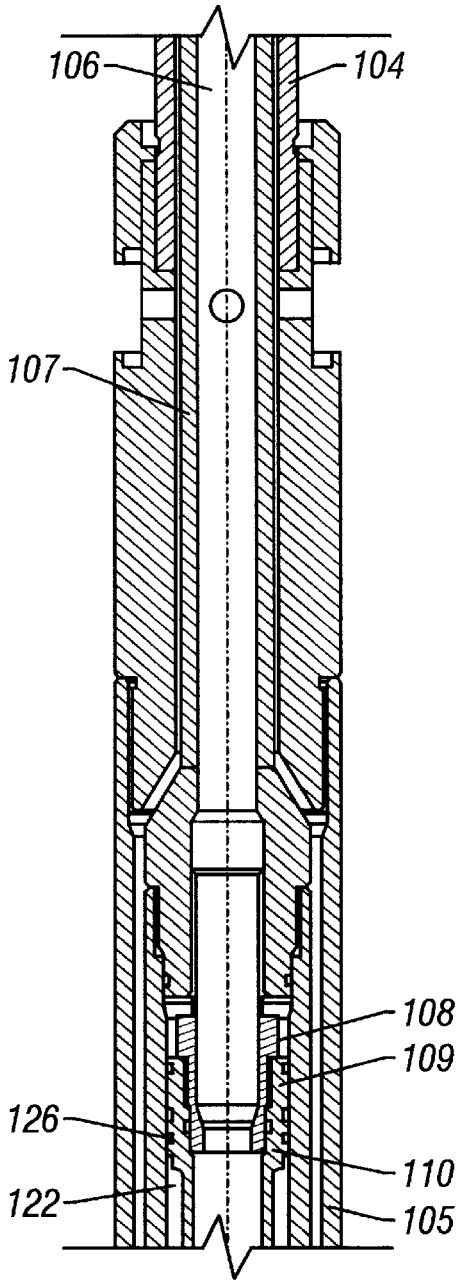
Figure 2C:
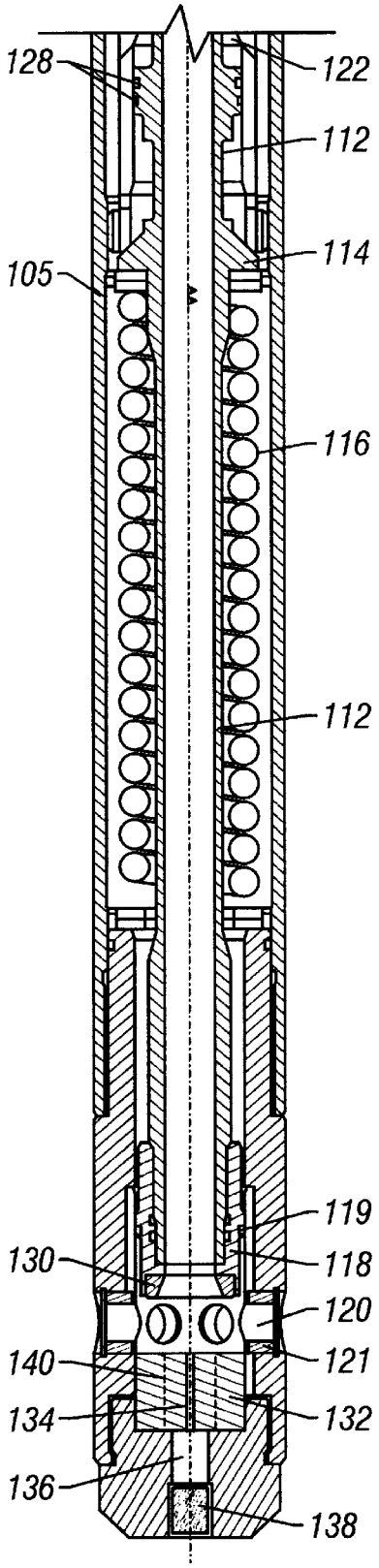

Referring to FIGS. 2A–2C, the dump valve 26 is illustrated in greater detail. The dump valve 26 has an upper section 104 that is connectable to the ported sub 27. The first housing section 104, which defines a central bore 106 through which fluid flow (e.g., fracturing fluid flow) can occur. The first housing section 104 is further connected to a second housing section 105.

An inner sleeve 107 extends inside the first housing section 104 and is connected to an inner portion of the second housing section 105. A flow restrictor device 108 is abutted to the lower end of the inner sleeve 107. The flow restrictor device 108 also sits on the upper end 109 of an operator mandrel 112.

The flow restrictor 108 has an opening or orifice 110 with an inner diameter less than the inner diameter of the bore 106. The purpose of the flow restrictor 108 is to create a pressure difference on the two sides of the flow restrictor 108 when fluid flows through the restrictor so that a downward force can be applied against the operator mandrel 112 located inside the dump valve 26.

The operator mandrel 112 has a flange portion 114 that is engaged to a helical spring 116 that is adapted to apply an upward force against the operator mandrel 112. Thus, absent a downwardly acting force on the operator mandrel 112, the spring 116 maintains the operator mandrel 112 in its up position, as shown in FIGS. 2A–2C.

The lower end of the operator mandrel 112 is connected to a sealing poppet 118. In the illustrated position of FIG. 2, the sealing poppet 118 is in its up (or open) position because the operator mandrel 112 is pushed upwardly by the spring 116. Ports 120 are located at the lower end of the dump valve 26 to enable fluid flow between the bore of the dump valve 26 and the outside wellbore region. The ports 120 are defined by a port housing 121. A sealing element 130 is provided at the lower end of the poppet 118. When the poppet 118 is moved downwardly, the sealing element 130 engages a seat 132 to form a seal. In some embodiments, to improve reliability of the dump valve 26, the sealing element 130, seat 132, port housing 121, and a sleeve 119 around the poppet 118 are formed of an erosion-resistant material, such as tungsten carbide.

In addition, a bore 134 is provided in the seat 132. The bore 134 leads into a chamber 136 that is sealed from the exterior environment by a plug 138. The bore 134 allows communication of fluids to a gauge that may be positioned where the plug 138 is located. To improve the life of the sealing element 130 of the poppet 118, the bore 134 can be increased in diameter (such as the inner diameter of the mandrel 112) to reduce fluid impact forces on the sealing element 130.

In the illustrated embodiment, a reference chamber 122 is also provided in an annulus space between the outside of the operator mandrel 112 and the inner wall of the housing section 105. The reference chamber 122 is sealed by seals 126 and 128. The purpose of the reference chamber 122 is to provide a reference pressure against which wellbore pressure can act across the operator mandrel 112 to generate an additional upward force on the operator mandrel 112 so that any downward pressure must overcome the force supplied by the spring 116 as well as an upwardly applied force supplied by the reference chamber 122. In alternative embodiments, the reference chamber 122 may be omitted. In yet other embodiments, the spring 116 may be omitted with the differential pressure between the wellbore fluid pressure and the reference pressure in the chamber 122 providing the primary opposing force to the pressure differential force across the flow restrictor 108.

In operation, the tool 22 is run into the wellbore 12 with the dump valve 26 in the open position, as shown in FIGS. 2B–2C. The dump valve 26 is in the open position because fluid flow is occurring inside the coiled tubing 14 and the tool 22 at a low rate. After some testing is performed to ensure that the tool 22 is operational, the tool 22 is lowered to a depth adjacent the formation 18. The sealing elements 28 and 30 define the sealed interval 32 into which fracturing fluids may be pumped.

A sequence of different fluids may be flowed down the tubing string. For example, a first type of fluid can be used to close the dump valve 26, followed by a flow of fracturing fluid. When flow of the first type fluid is started, a pressure difference is applied across the flow restrictor 108. If a sufficiently high pressure is created across the flow restrictor 108 (which is dependent on the fluid flow rate) being greater than a predetermined rate, the force supplied by the differential pressure overcomes the opposing forces supplied by the spring 116 and the reference chamber 122. As a result, the operator mandrel 112 is pushed downwardly, which moves the sealing poppet 118 downwardly to seal the ports 120 so that the dump valve 26 is closed. Fracturing fluid is then communicated through the ports 24 of the ported sub 27 (FIG. 1) into the annulus region 32 and the surrounding formation 18.

After fracturing is completed, the pumping pressure is removed and fluid flow is stopped. This removes the pressure difference across the flow restrictor 108 so that the upward force applied by the spring 116 and the reference chamber 122 can move the operator mandrel 112 upwardly. This moves the sealing poppet 118 away from the ports 120 so that communication between the inside of the dump valve 26 and the wellbore 12 is again re-established. At this point, any slurry or other debris in the annulus region 32 in the coiled tubing 14, and in the tool 22 is dumped through the ports 120 into the wellbore 12.

Because of the likely presence of heavy fluid that may be present, the fluid may be dumped, or fall freely, through the open dump valve 26 at a relatively fast rate. The relatively fast flow rate may actually cause the dump valve 26 to close again, which is an undesirable result. To avoid this, another flow restrictor 200 (FIG. 2A) having a reduced flow control orifice 201 is placed in the dump valve 26 to control the free fall rate of the fluid through the dump valve 26. A plurality of flow restrictors can thus be provided in the dump valve 26. In one arrangement, this flow restrictor 200 is independent of the valve operator.

Another issue with dumping fluid through the dump valve 26 is that the region below the dump valve 26 may be unable to accept the additional fluid. If the lower region is unable to accept fluid, a bypass element in the form of one or more channels (represented as 29 in FIG. 1) can be included in the tool 22 to enable displacement of fluid to above the tool 22 where the fluid can be removed from or absorbed by the wellbore. Additionally, the bypass element may provide for more efficient run-in of the tool 22.

The same fracturing operations may be performed in other zones (if applicable) in the wellbore. This is accomplished by moving the straddle packer tool 22 proximal the other zones and repeating the operations discussed above. The tool 22 can thus be used a plurality of times for plural zones without removing the tool 22 from the wellbore.

Yet another issue that may be encountered is that the dump valve may be stuck in the close position so that halting of fluid flow does not open the dump valve. If that occurs, then pressure may be applied from the well surface down the tubing-casing annulus 13 and through the straddle packer tool 22 (by means of the bypass channel 29) to the dump valve 26. The increased annulus pressure is communicated into the dump valve 26 through ports 120 (FIG. 2C) to act on a lower shoulder 119 of the poppet 118 to push it upwardly.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A tool for use in a wellbore, comprising:

a sealing assembly to define a first zone;

a valve; and a valve operator responsive to fluid flow to actuate the valve from an open to a closed position, wherein the valve operator comprises a plurality of flow restrictors and wherein at least one of the flow restrictors controls fluid free fall rate through the valve to prevent inadvertent activation of the valve.

2. The tool of claim 1, wherein the sealing assembly comprises a straddle packer tool.

3. The tool of claim 2, wherein the straddle packer tool comprises two sealing elements to define the first zone.

4. The tool of claim 2, comprising a fracturing tool.

5. The tool of claim 1, further comprising a tubing to receive the fluid flow.

6. The tool of claim 5, wherein the tubing comprises jointed tubing.

7. The tool of claim 5, wherein the tubing comprises coiled tubing.

8. The tool of claim 1, wherein the at least one flow restrictor is independent of the valve operator.

9. The tool of claim 1, wherein a pressure difference is created across the flow restrictors due to the fluid flow.

10. The tool of claim 9, wherein the valve operator comprises an operator member coupled to the plurality of flow restrictors, the operator member adapted to be moved by the pressure difference across the plurality of flow restrictors.

11. The tool of claim 10, further comprising a spring to oppose movement of the operator member.

12. The tool of claim 10, further comprising a chamber containing a reference pressure, wherein differential pressure between wellbore fluid pressure and the reference pressure generates a force to oppose movement of the operator member.

13. The tool of claim 10, wherein the valve comprises a poppet attached to the operator member.

14. The tool of claim 13, wherein the valve further comprises one or more ports that the poppet is adapted to cover and uncover.

15. The tool of claim 14, further comprising:

a port housing defining the one or more ports; and a seat, wherein the poppet has a sealing element engageable with the seat.

16. The tool of claim 15, wherein the port housing, seat, and sealing element are formed at least in part of an erosion-resistant material.

17. The tool of claim 15, wherein the seat has an inner bore.

18. The tool of claim 1, wherein the valve is positioned downstream of the sealing assembly.

19. The tool of claim 1, wherein the sealing assembly comprises a packer.

20. The tool of claim 19, wherein the sealing assembly comprises another packer, the first zone defined between the packers.

21. The tool of claim 19, wherein the valve comprises at least one port positioned below the packer.

22. The tool of claim 1, wherein the valve operator is responsive to fluid flow of greater than or equal to a predetermined flow rate.

23. The tool of claim 1, wherein the sealing assembly comprises a bypass element to enable communication of fluid flow or pressure between a region above the sealing assembly and a region below the sealing assembly.

24. A fracturing string for use in a wellbore, comprising:

a fluid conduit to receive fluid; and a flow-operated valve assembly adapted to be actuated between an open and closed position by fluid flowing in the fluid conduit and through the valve assembly at greater than a predetermined rate; wherein the flow-operated valve assembly comprises a valve operator movable in response to flow of fluid during a fracturing sequence and having one or more flow restrictors across which a pressure difference is created due to such flow of fluid.

25. The fracturing string of claim 24, further comprising a sub having one or more ports through which the fluid can flow to a wellbore zone.

26. The fracturing string of claim 25, wherein the flow-operated valve assembly is positioned below the sub.

* * * * *